United States Patent [19]

Meijer et al.

[11] Patent Number: 4,481,771

[45] Date of Patent: Nov. 13, 1984

[54] HEAT EXCHANGER STACK APPARATUS

[75] Inventors: Roelf J. Meijer; Benjamin Ziph, both of Ann Arbor, Mich.

[73] Assignee: Stirling Thermal Motors, Inc., Ann Arbor, Mich.

[21] Appl. No.: 405,749

[22] Filed: Aug. 6, 1982

[51] Int. Cl.[3] ..... F02G 1/04

[52] U.S. Cl. ..... 60/517

[58] Field of Search ..... 60/517, 524, 525, 526

[56] References Cited

U.S. PATENT DOCUMENTS

| | | | |
|---|---|---|---|
| 3,831,380 | 8/1974 | Nederlof | 60/524 |
| 4,172,363 | 10/1979 | Bex | 60/517 |
| 4,365,474 | 12/1982 | Carlqvist | 60/525 |

*Primary Examiner*—Allen M. Ostrager

*Attorney, Agent, or Firm*—Stephenson and Boller

[57] ABSTRACT

A heat exchanger stack apparatus for use on a remotely heated Stirling engine having a variable swashplate drive mechanism, which comprises rigidly combining a regenerator, a flexible heat exchanger, a short, rigid hot connecting duct and a cylinder. A heat exchanger stack apparatus for each cylinder of the engine is mounted on a drive mechanism housing with the regenerator adjacent to a cooler located within the drive mechanism housing. The cooler, regenerator and flexible heat exchanger are axially aligned providing a linear flowpath for the engine working fluid. Bellows and flexible tubes connected to the flexible heat exchanger provide axial and transverse flexibility to reduce thermal stresses within the heat exchanger stack apparatus.

6 Claims, 10 Drawing Figures

HEAT EXCHANGER STACK APPARATUS

BACKGROUND OF THE INVENTION

1. Field of the Invention

This invention pertains to Stirling engines, and more particularly to remotely heated Stirling engines, wherein a working fluid is alternately compressed and expanded by means of pistons further connected to an output drive mechanism. A cooler and a heater, transferring heat to and from the working fluid cause it to be compressed at a lower temperature and expanded at a higher temperature thereby to produce mechanical power. A regenerator, located between the cooler and the heater, increases the efficiency.

2. Description of the Prior Art

Stirling engines having a plurality of cylinders arranged in a "v" configuration utilizing heat pipes to transfer heat from external sources have already been described in the document entitled *Large Stationary Stirling Engine—Final Report.*

In the Stirling engines according to the above referenced document, a heat transport system is utilized to provide heat from a remote source to a heat exchanger for subsequent transfer of such heat to a separate working fluid.

The heat exchanger disclosed therein is enclosed in a rigid housing in combination with a regenerator and a cooler for alternately heating and cooling the working fluid. The working fluid flows back and forth between the housing containing the heat exchanger, regenerator and cooler, and the cylinders through the long hot and cold manifolds connected therebetween. The long hot and cold manifolds have small cross sectional areas with low section moduli to provide sufficiently low bending stiffness to allow thermal expansion of such manifolds and of the rigid enclosure containing the heat exchanger, regenerator and cooler.

SUMMARY OF THE INVENTION

The improved heat exchanger stack apparatus for use on a remotely heated Stirling engine, according to the present invention, is characterized by combining a regenerator, a flexible heat exchanger, a short, rigid hot connecting duct and a cylinder into a rigid assembly. A plurality of heat exchanger stack apparatuses, one for each cylinder of the engine, are then rigidly fastened to a drive mechanism housing. A cooler for each cylinder is located within the drive mechanism housing such that engine working fluid passes along a common axis through the cooler, regenerator and flexible heat exchanger associated therewith. The hot connecting duct allows engine working fluid to flow between the flexible heat exchanger and the cylinder.

The heat exchanger, regenerator, hot connecting duct and cylinder expand as hot engine working fluid is passed therethrough. To eliminate thermal stresses caused by such expansion, the heat exchanger is made flexible in axial and transverse directions by a bellows and flexible tubes associated therewith. The flexible feature of the heat exchanger allows the hot connecting duct to be short and rigid unlike former Stirling engine designs which employed long, small diameter hot connecting ducts to accomodate thermal expansion.

The short hot connecting duct reduces the total volume of engine working fluid thereby gaining two major advantages over former Stirling engine configurations. First, the power of the engine increases as the ratio of volume swept by the piston to the total volume of working fluid increases. Reduction of the total volume of engine working fluid accomplishes an increase in the ratio. Second, frictional flow losses of the engine working fluid are reduced by the reduction in length of the hot connecting duct.

A further object of the present invention is to minimize manufacturing costs of the heat exchanger stack apparatus. Electron beam welding is used to form rigid connections between the regenerator, flexible heat exchanger, hot connecting duct and cylinder housing. The bellows and flexible tubes are oven brazed onto the heat exchanger. The low thermal mass of the bellows, flexible tubes and heat exchanger allows rapid and energy efficient brazing unlike former designs using long heater tubes individually brazed onto the cylinder housing and regenerator housing requiring the large thermal mass thereof to reside in the brazing oven.

BRIEF DESCRIPTION OF THE DRAWINGS

Further details are explained below with the help of the examples illustrated in the attached drawings in which.

DESCRIPTION OF THE PREFERRED EMBODIMENTS

Figure 1:
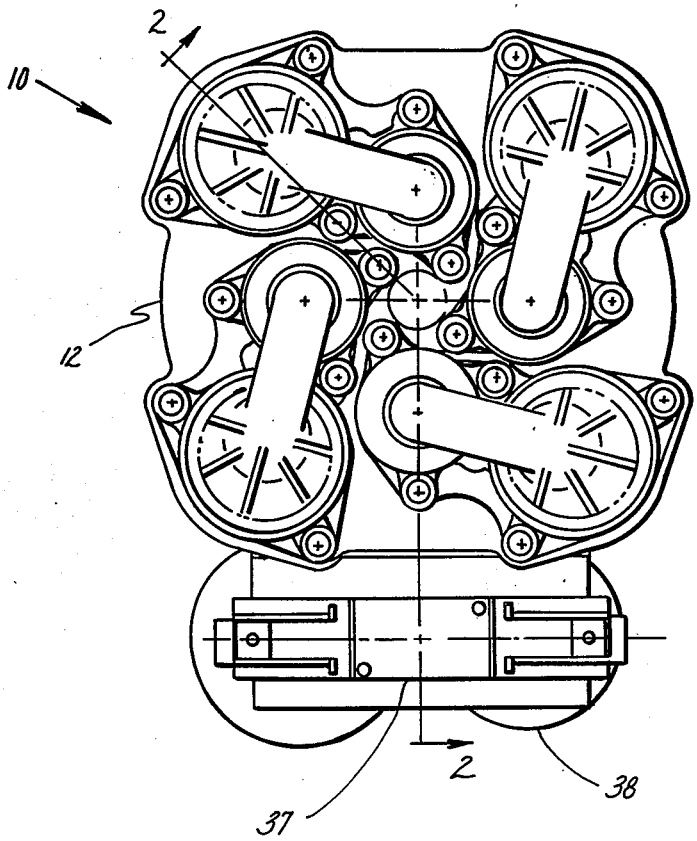
FIG. 1 shows an overall end view of Stirling engine.
Figure 2:
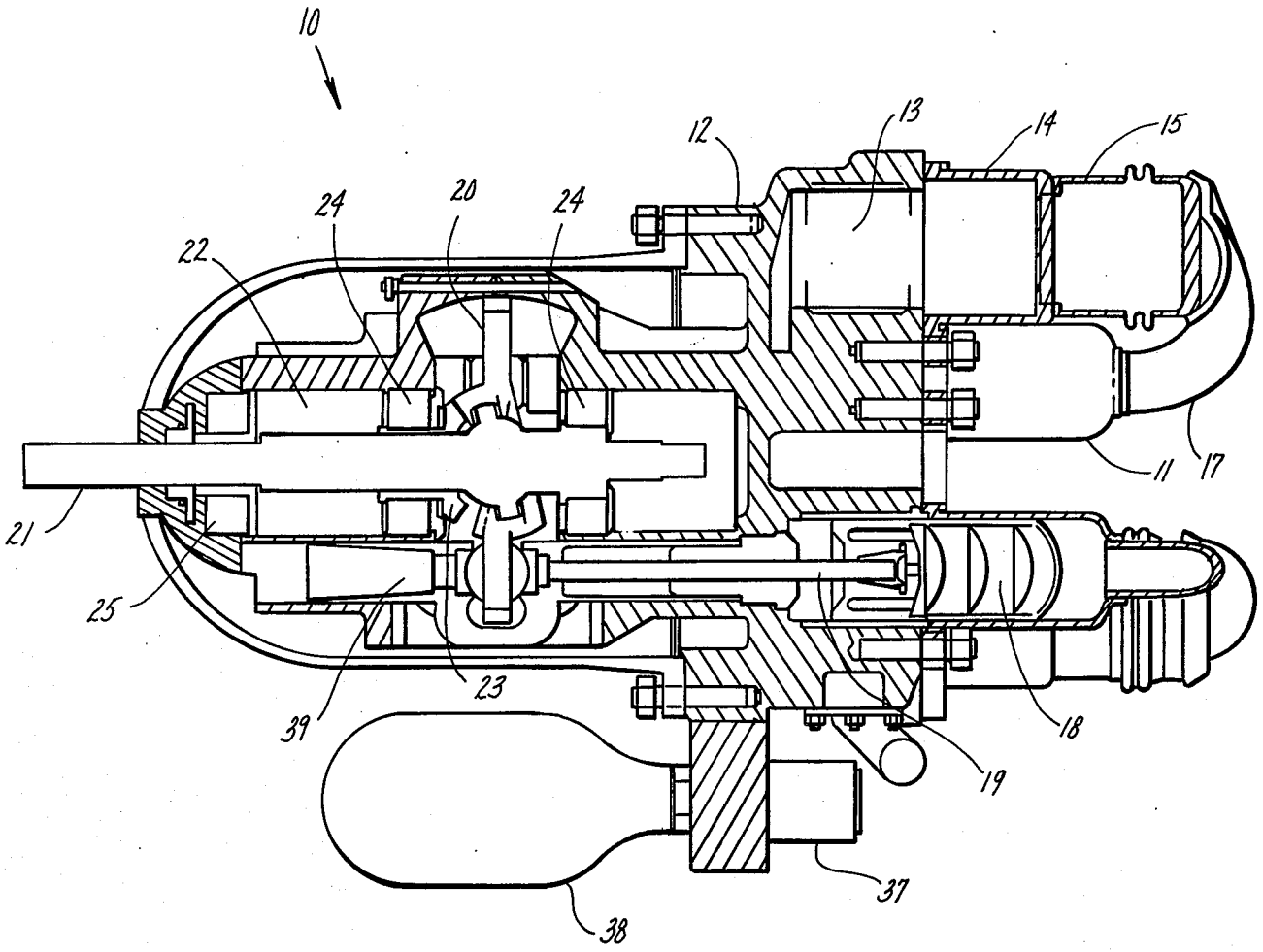
FIG. 2 shows a longitudinal cross sectional view of the engine as viewed from substantially the line 2—2 in FIG. 1.

The Stirling engine according to the present invention is shown in FIGS. 1 and 2 generally at reference numeral 10. More particularly, four substantially parallel cylinders 11 are disposed in a square cluster about a central axis within a drive mechanism housing 12. Associated with each cylinder 11 and located on an end surface of drive mechanism housing 12 is a heat exchanger combination comprising cooler 13, regenerator 14 and a flexible heat exchanger 15 located in a substantially parallel orientation with respect to each cylinder. A short rigid hot connecting duct 17 connects cylinder 11 to flexible heat exchanger 15. Regenerator 14, flexible heat exchanger 15, hot connecting duct 17 and cylinder 11 form a separate apparatus described more particularly below. Cooler 13 is located within drive mechanism housing 12.

Located within each cylinder 11 is a movable piston 18 and a connecting rod 19 rigidly affixed thereto. Swashplate 20 converts the reciprocating axial motion of piston 18 to rotary motion of output shaft 21 which is supported by main bearings 24 and thrust bearing 25. The angle of swashplate 20 is variable from 0° to 22° by rotating swashplate 20 relative to a tilted section of output shaft 21 to vary the power output of the engine. This rotation is effected by a hydraulic stroke converter 22 and transmitted to swashplate 20 by bevel gear 23. As the angle of swashplate 20 increases, piston stroke increases and engine power output increases due to such increased stroke and the increase in the ratio of volume swept by the pistons to total volume of engine working fluid. Hydraulic fluid is supplied to and returned from stroke converter 22 by concentric tunnels in output shaft 21. Fluid supply and return is controlled by power control valve 37 and adjacent accumulator 38. Crosshead 39 slidably connects piston connecting rod 19 to swashplate 20.

Figure 4:
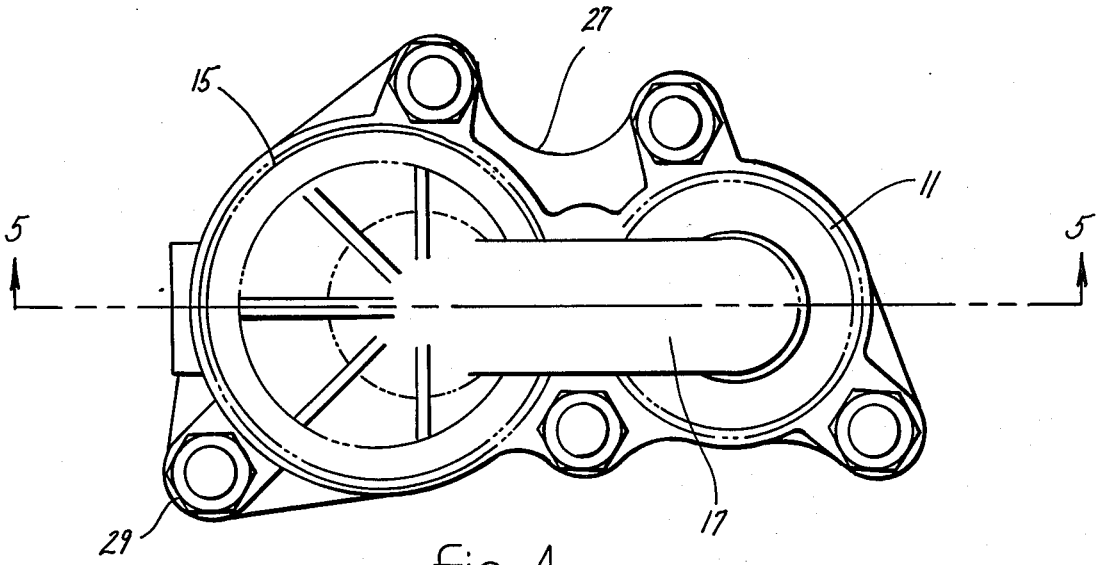
FIG. 4 is an overall top view of the heat exchanger stack apparatus according to FIG. 3.
Figure 3:
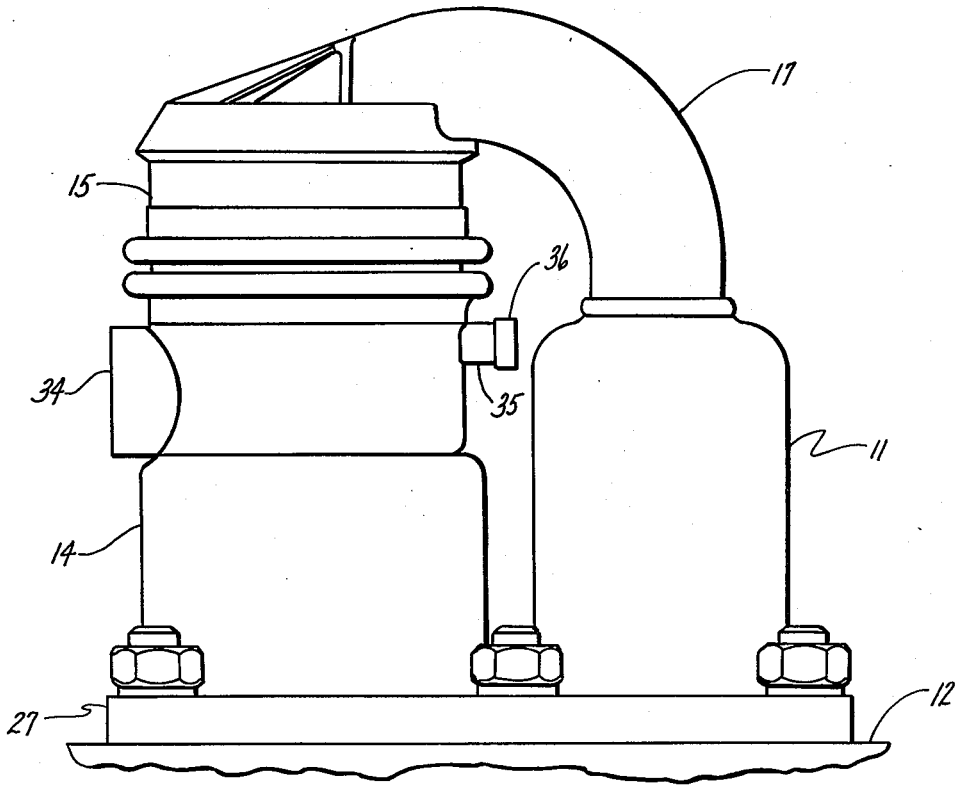
FIG. 3 is an overall side view of the heat exchanger stack apparatus shown fastened to the drive mechanism housing.
Figure 6:
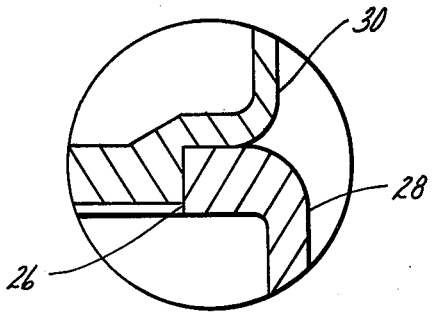
FIG. 6 is a removed portion of the cross section shown in FIG. 5 on an enlarged scale showing the rigid connection between the flexible heat exchanger and the regenerator.

The heat exchanger stack apparatus is shown more particularly in FIGS. 3 and 4. A first end of cylindrically shaped regenerator 14 is rigidly connected to a first end of cylindrically shaped flexible heat exchanger 15. The rigid connection therebetween is formed by a continuous electron beam weld 26 shown in more detail in FIG. 6. Regenerator 14 and flexible heat exchanger 15 are oriented such that after assembly the axes of revolution of each lie along a common axis. A second end of flexible heat exchanger 15 is electron beam welded to a short, rigid hot connecting duct 17 which extends therefrom to a first end of cylinder 11, whereat a rigid connection therebetween is also accomplished by an electron beam weld. Hot connecting duct 17 has a large end at the point of connection to flexible heat exchanger 15 and the smaller end at the point of connection to cylinder 11. The shape of the portion of the hot connecting duct 17 between the large and small ends thereof is smooth and curving to minimize frictional flow losses as engine working fluid passes therethrough.

Figure 5:
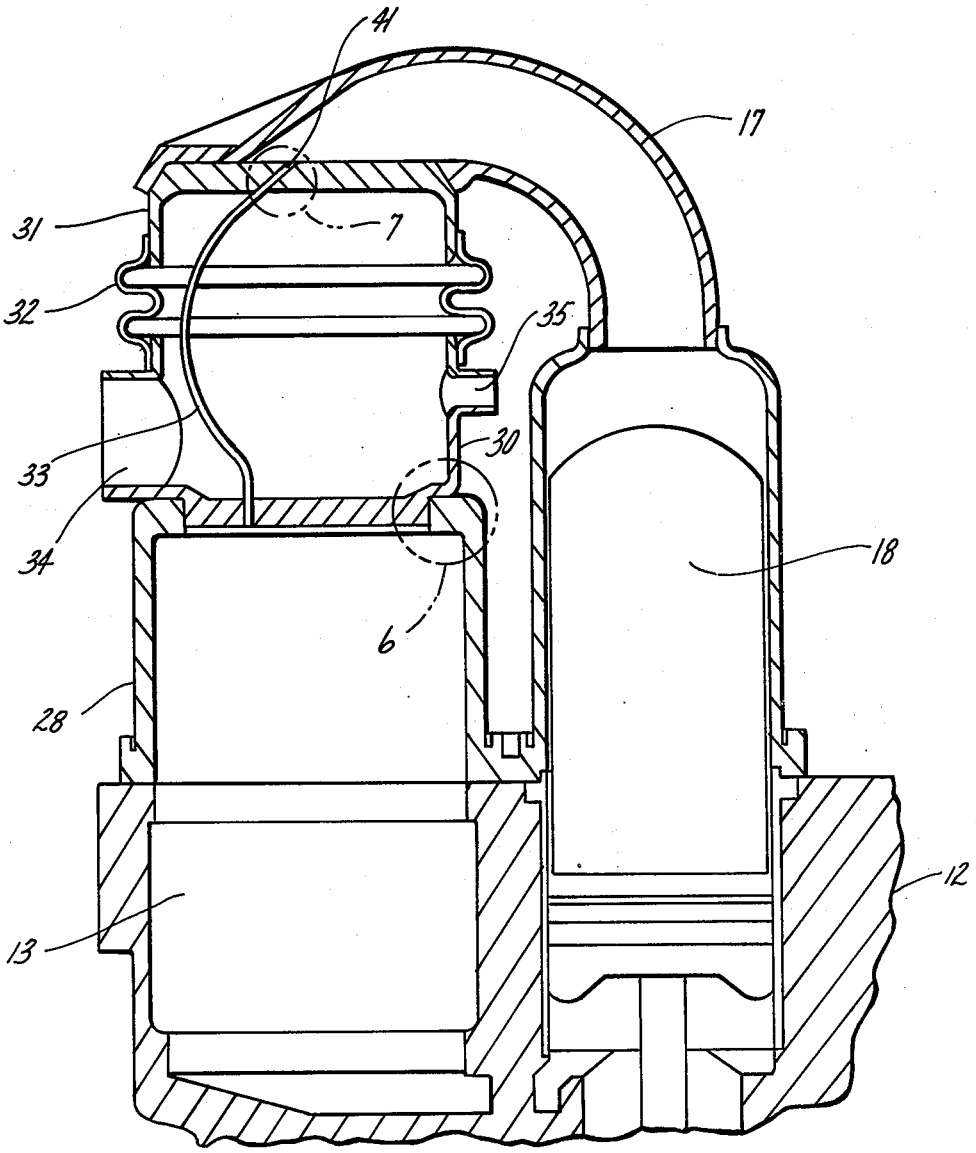
FIG. 5 is a longitudinal cross sectional view of the stack apparatus as viewed from substantially the line 5—5 in FIG. 4.

Cylinder 11, regenerator 14 and mounting flange 27 are combined in a single casting 28 for manufacturing ease as shown in FIG. 5. Mounting flange 27 rigidly connects the second end of regenerator 14 to the second end of cylinder 11, and is substantially perpendicular to the axes of revolution of regenerator 14 and cylinder 11. A plurality of fastener holes 29, extending through mounting flange 27, are provided to accomodate fasteners to rigidly connect each heat exchanger stack apparatus to the end surface of drive mechanism housing 12, as shown in FIG. 3.

The flexible heat exchanger 15 is comprised of first and second hollow cannisters, 30 and 31 respectively, flexibly connected with a bellows 32 to form an interior volume as shown in FIG. 5. A plurality of flexible tubes 33 extend internally between the first and second ends of flexible heat exchanger 15 to allow the engine working fluid to flow therethrough, within the tubes 33 along the axis of revolution of flexible heat exchanger 15. A port 34 allows heating fluid to communicate with the interior volume of flexible heat exchanger 15 and thereby contact the flexible tubes 33 to facilitate heat transfer from the heating fluid to the engine working fluid. Port 34 is rigidly connected to a wall surface of flexible heat exchanger 15 as shown in FIGS. 3 and 5.

Figure 8:
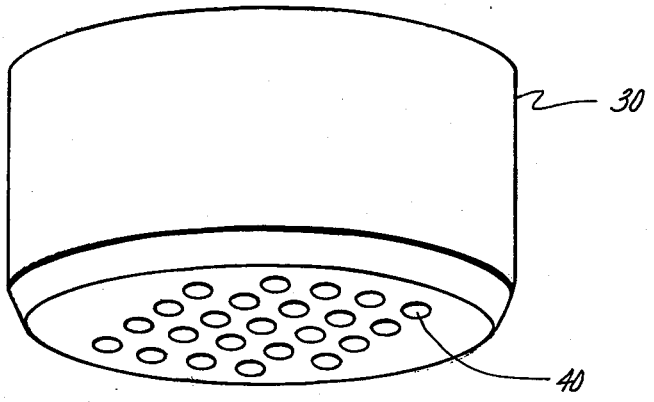
FIG. 8 is an overall view of a hollow cannister portion of the flexible heat exchanger.
Figure 9:
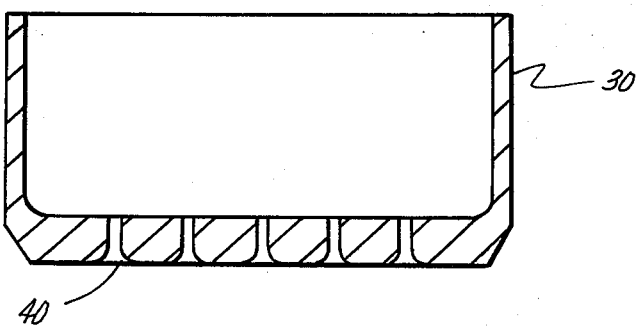
FIG. 9 is a cross sectional view according to FIG. 8 showing a plurality of flared perpendicularly extending holes extending through the flat plate portion thereof.

First hollow cannister 30 is substantially right circular cylindrically shaped having a first end closed by a structurally integral flat plate oriented substantially perpendicular to the axis of revolution thereof, and an open second end as FIGS. 8 and 9 illustrate. Second hollow cannister 31 is substantially similar to first hollow cannister 30.

Figure 7:
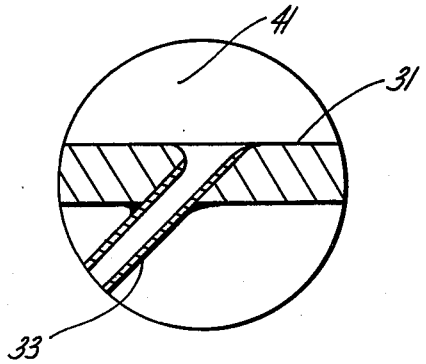
FIG. 7 is a portion of the cross section shown in FIG. 5 on an enlarged scale showing a flared, angularly extending hole through the flat plate portion of the second hollow cannister with a tube affixed thereto.

The flat plate portion of first hollow cannister 30 has a plurality of holes 40, substantially perpendicular thereto, extending therethrough to accomodate first ends of the flexible tubes 33 and allow passage of the engine working fluid between the flexible heat exchanger 15 and regenerator 14. A plurality of angularly extending holes 41 pass through the flat plate portion of second hollow cannister 31 to accomodate second ends of the flexible tubes 33 and allow passage of the engine working fluid between the flexible heat exchanger 15 and hot connecting duct 17. The holes 41 extend at an angle to minimize frictional fluid flow loss of the engine working fluid as the direction of flow thereof changes from along the flexible heat exchanger 15 to along hot connecting duct 17, as shown by FIGS. 5 and 7.

The flexible tubes 33 are curved, as FIG. 5 shows, to allow axial and transverse displacement of second hollow cannister 31 with respect to first hollow cannister 30. The curvature of the flexible tubes 33 is outwardly away from cylinder 11 to minimize fluid flow loss of the engine working fluid by providing a relatively smooth transition from the substantially parallel flow direction near the flat plate portion of first hollow cannister 30 to the more angular flow direction near the flat portion of the second hollow cannister 31.

Cooler 13 is a substantially prismatically shaped heat exchanger of either tube or plate type, and is located in drive mechanism housing 12 as FIG. 5 shows. Orientation of cooler 13 is such that the axis thereof is substantially perpendicular to the surface of drive mechanism housing 12 that connects to mounting flange 27.

Regenerator 14 is oriented with the second end thereof adjacent to cooler 13 such that the common axis of regenerator 14 and flexible heat exchanger 15 coincides with the axis of cooler 13. The aligned configuration of cooler 13, regenerator 14 and flexible heat exchanger 15, illustrated in FIG. 5, allows the engine working fluid to flow therethrough along the common axis with a minimum of frictional flow loss.

Port 34 in the preferred embodiment is capable of accepting a liquid metal heat pipe. Metal vapor flows from the heat pipe into the interior volume of flexible heat exchanger 15, through port 34 wherein it contacts exterior surfaces of the flexible tubes 33. Heat is transferred from the vapor to the flexible tube material and subsequently to the engine working fluid. Such heat transfer causes the metal vapor to condense, whereupon the liquid condensate is removed from the interior of flexible heat exchanger 15 through port 34 and into the heat pipe. Another port 35, sealable at one end and rigidly connected to a wall surface of flexible heat exchanger 15, is provided to evacuate the interior volume of flexible heat exchanger 15 and the heat pipe connected thereto. Port 35 facilitates such evacuation by providing a connection for a vacuum pump. After a vacuum pump has been operated thereby evacuating the interior volume, port 35 is sealed to prevent re-entry of air by urging valve 36 into a closed position. As an alternative to using valve 36, a portion of port 35 can be crimped to provide a seal to maintain these operating conditions. Evacuation is necessary to prevent the metallic heat transport fluid of the heat pipe from reacting with air and to allow the heat pipe to operate at the desired vapor pressure which is generally lower than ambient. Flexible heat exchanger 15 and the heat pipe connected thereto are vacuum sealed from the ambience. A latent heat transfer loop is an alternative method of transporting heat to the flexible tubes 33 and comprises rigidly mounting two such ports 34 onto wall surfaces of flexible heat exchanger 15 and passing the heating fluid through the interior volume therof. Flexible tubes 33 prevent mixing of the engine working fluid and the heating fluid and can withstand a pressure therein of 14 MPa at 800° C.

As the total volume of engine working fluid enclosed in the engine increases, the power of the engine decreases provided there is no increase in swept volume of the pistons. Therefore, an object of the present invention is to provide a flow path of minimum volume for the engine working fluid. The use of a short hot connecting duct 17 attains this object by providing a short, smooth connection between flexible heat exchanger 15 and cylinder 11. During the engine starting period, hot connecting duct 17 expands due to the temperature increase from the engine working fluid flowing therethrough at up to 800° C. The regenerator 14 and cylinder 11 also expand due to the same thermal effect. Bellows 32 and flexible tubes 33 allow first and second hollow cannister portions 30 and 31 respectively of flexible heat exchanger 15 to move in axial and transverse directions with respect to one another. The combined stiffness of bellows and 32 and flexible tubes 33 is low in axial and transverse directions, thereby reducing stresses due to the deformation required to reconcile the thermal expansion of the cylinder 11 and the hot connecting duct 17 with that of the regenerator 14 and the flexible heat exchanger 15. The low stiffness of the flexible tubes 33 located within flexible heat exchanger 15 is due to their curvature.

Figure 10:
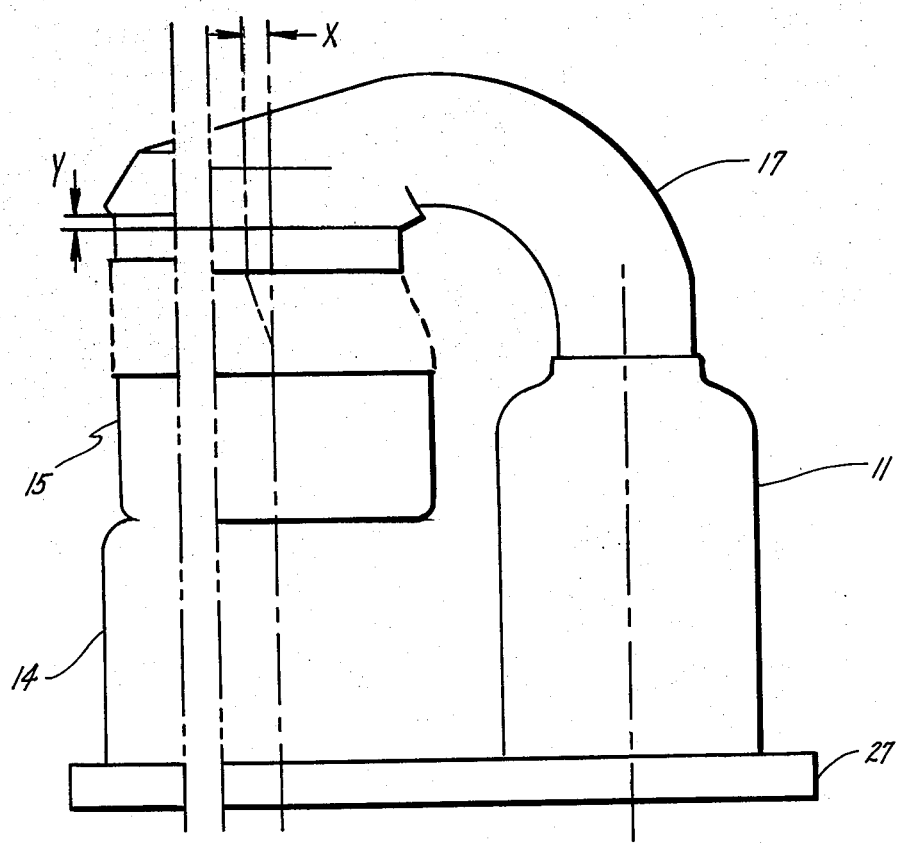
FIG. 10 is an overall side view of the heat exchanger stack apparatus showing the flexible heat exchanger displaced a distance x axially and a distance y transversely.

FIG. 10 shows the heat exchanger stack apparatus during operation of a Stirling engine already having attained a steady state temperature. The right side of FIG. 10 illustrates the operation of bellows 32 and flexible tubes 33 allowing the second hollow cannister 31 of flexible heat exchanger 15 to displace a transverse distance x due to thermal expansion of the hot connecting duct 17. Operating at steady state high temperature, the axial thermal expansion of regenerator 14 and flexible heat exchanger 15 is greater than that of cylinder 11 and the adjoining portion of hot connecting duct 17. Therefore bellows 32 and flexible tubes 33 allow compressive axial displacement y of the second hollow cannister 31 with respect to the first hollow cannister 30.

Regenerator-cylinder casting 28, first and second hollow cannisters 30 and 31 respectively and hot connecting duct 17 are investment cast of CRM-6D iron based alloy. Bellows 32 and flexible tubes 33 are brazed to first and second hollow cannisters 30 and 31 in a brazing oven to form flexible heat exchanger 15. Electron beam welds rigidly connect flexible heat exchanger 15 to regenerator 14 and hot connecting duct 17 and further connect hot connecting duct 17 to cylinder 11.

While the particular embodiments of the instant invention have been described and shown, it will be understood that many modifications may be made without departing from the spirit thereof, and it is contemplated by the appended claims to cover any such modifications as fall within the true spirit and scope of the instant invention.

What is claimed is:

1. In a Stirling engine which includes a heat exchanger arranged in a stacked generally aligned relation with a cooler and a regenerator so that the regenerator is located at one end of the heat exchanger, with a connecting duct at the opposite end of the heat exchanger, the improvement comprising means forming part of said heat exchanger providing for flexibility of said heat exchanger so that the internal volume of said heat exchanger can contract and expand in response to heating and cooling thereof, and a plurality of tubes in said heat exchanger communicating at their ends with and extending between said regenerator and said duct so that engine working fluid flowing through said tubes can be heated in said heat exchanger.

2. Apparatus according to claim 1 wherein said heat exchanger comprises a pair of hollow canister members arranged in an aligned spaced relation and a bellows connected to and extending between the adjacent ends of said canisters.

3. Apparatus according to claim 2 wherein said canisters have opposing end walls provided with a plurality of openings and cylinderical side walls which extend toward each other, said tubes being secured to said end walls in communication with said openings and extending in curved paths between said end walls.

4. Apparatus according to claim 3 wherein said cooler, regenerator and heat exchanger are arranged in coaxial relation to enable engine working fluid to flow therethrough with a minimum of frictional flow loss.

5. Apparatus according to claim 3 wherein said duct is inclined with respect to said heat exchanger, said openings in the heat exchanger through which said tubes communicate with said duct being inclined in the direction of said duct inclination to promote a smoothly contoured flow of working fluid between said tubes and said duct.

6. Apparatus according to claim 3 further including port means in a side wall of one of said canisters for admitting heating fluid to said heat exchanger for flow in a heat exchange relation with the working fluid in said tubes.

* * * * *